US007661157B2

(12) United States Patent
McCluskey et al.

(10) Patent No.: US 7,661,157 B2
(45) Date of Patent: Feb. 16, 2010

(54) PORTABLE CRIB OR CONTAINMENT DEVICE

(76) Inventors: John F. McCluskey, 4169 Oak Hill Ave., Palo Alto, CA (US) 94306; Sharon Lake, 300 Sequola, Palo Alto, CA (US) 94306; Katherine Bickert, 479 Bartlett, San Francisco, CA (US) 94110; Susan M. Schmitt, 11565 Old Ranch La., Los Altos Hills, CA (US) 94024

( * ) Notice: Subject to any disclaimer, the term of this patent is extended or adjusted under 35 U.S.C. 154(b) by 104 days.

(21) Appl. No.: 11/977,340

(22) Filed: Oct. 23, 2007

(65) Prior Publication Data

US 2008/0115268 A1 May 22, 2008

Related U.S. Application Data

(60) Provisional application No. 60/854,560, filed on Oct. 25, 2006.

(51) Int. Cl.
*A47D 7/00* (2006.01)
*A47D 13/061* (2006.01)

(52) U.S. Cl. ..... 5/99.1; 5/93.1; 5/945; 5/98.1

(58) Field of Classification Search ..... 5/93.1, 5/99.1, 98.2, 945, 98.1
See application file for complete search history.

(56) References Cited

U.S. PATENT DOCUMENTS

| | | | | | |
|---|---|---|---|---|---|
| 3,430,271 | A * | 3/1969 | Junod-Deile | ..... | 5/93.1 |
| 4,129,139 | A | 12/1978 | Powers | | |
| 4,186,454 | A * | 2/1980 | Cone | ..... | 5/99.1 |
| 4,202,065 | A * | 5/1980 | Sullivan | ..... | 5/99.1 |
| 4,815,153 | A | 3/1989 | Bleser et al. | | |
| 4,827,542 | A | 5/1989 | Kurtenbach | | |
| 5,341,350 | A | 8/1994 | Frank et al. | | |
| 5,345,622 | A * | 9/1994 | Plone | ..... | 4/588 |
| 6,799,338 | B1 * | 10/2004 | Hsia | ..... | 5/93.1 |
| 2004/0131801 | A1 | 7/2004 | Wong | | |
| 2005/0166316 | A1 * | 8/2005 | Gehr et al. | ..... | 5/99.1 |
| 2005/0236025 | A1 | 10/2005 | Gale et al. | | |

* cited by examiner

*Primary Examiner*—Alexander Grosz

(57) ABSTRACT

A portable travel crib, play yard or other infant or child containment device is provided. The device may have longitudinal support structures. The device may also have an upper peripheral support structure provides an outward compressive force.

22 Claims, 12 Drawing Sheets

PORTABLE CRIB OR CONTAINMENT DEVICE

This application claims benefit of Provisional patent application Ser. No. 60/854,560 filed Oct. 25, 2006.

FIELD OF THE INVENTION

The invention relates to portable cribs, play yards or other child or infant containment devices.

BACKGROUND OF THE INVENTION

Very few portable cribs are currently available that provide a combination ease of use and transport with function. Most existing cribs/play yards are not suited for convenient travel or set up, they are bulky, they provide poor support and/or are heavy. Accordingly it would be desirable to provide a portable crib that is easy to set up, take down and transport or that is a lightweight alternative.

SUMMARY OF THE INVENTION

According to one aspect of the invention a series of generally longitudinal support members is provided. The longitudinal support members may be oriented in a non-parallel manner with respect to each other to thereby provide stability and counteract a collapsing force applied to the crib between adjacent longitudinal support members. The longitudinal support members may be positioned to generally form alternating peaks and valleys respectively at the top and bottom of the crib. The longitudinal support members may be independent from each other, contiguous with each other, or may be attached to each other, e.g., with an attachment device at the top and/or bottom of the device. The longitudinal support members may be strut members or inflatable portions but are not limited thereto.

According to one aspect, the longitudinal support members are struts coupled to each other in a manner that permits folding of the device or collapsing of the struts with respect to one another. The struts may be coupled to each other with a coupling device, they may be coupled to each other with the fabric forming the crib or may be otherwise foldable or collapsible with respect to each other.

Another aspect of the invention comprises a curved structure that provides compression, i.e. provides radial compressive forces that hold the struts in position with respect to each other to provide stability to the longitudinal structure of the containment device in a deployed position. According to one aspect, the curved structure comprises an inflatable structure. According to another aspect, such an inflatable structure comprises a torroidal structure with a cross sectional radius and an overall curved or generally circular shape with a radius. The curved structure is further is sized to prevent deformation. In accordance with this aspect the size of the curved structure may be determined generally based in the following relationship: the strength of the torroid is proportional to $Mt(r/R)^3$, where M is the modulus of strength of the material, t is the thickness of the material and r is the radius of the torroidal tube and R is the radius of the ring formed by the tube.

According to another aspect of the invention, upper and lower support structures are provided that provide radially outward compressive forces. The radially outward forces of the upper and lower support structures generally immobilize the longitudinal support members with respect to each other. The circumferential radial compressive support is provided at the top of the containment device by the upper support structure. In accordance with another aspect of the invention, a circumferential radial compressive force is provided at the bottom of the containment device by the lower support structure. The radially outward compressive force may be provided for example using an inflated torroidal ring member. Alternatively a circumferential spring member may be provided. Also, for example a solid or inflatable member such as e.g. a mattress may be slightly oversized for the inner circumference of the containment device to provide a compressive force when inserted into the containment device.

According to one aspect of the invention, one or more of the support structures may be inflatable. This may include the upper lower and/or longitudinal support structures. In accordance with one aspect of the invention, the strut shaped supports are inflated. Each of the struts is positioned at an obtuse or acute angle with respect to the circumference of the bottom of the crib.

According to one aspect of the invention, a device is provided that comprises a combination of collapsible structure and inflatable/deflatable structure.

In general in accordance with an embodiment, a containment device comprises cylindrical or preferable conical shape with an open top. A material such as a mesh is provided around the circumference of the conical or cylindrical portion. The top of the conical portion has a curved opening having a radius. Support members are provided that are not parallel to each other, i.e. they form an angle with respect to each other. They may generally provide a series of peaks and valleys about the circumference. The supports may be provided from top to bottom, they may cross over, and/or a series of supports forming peaks and valleys in a diamond or series of diamond shapes may be provided. This structure provides an increased columnar support when, for example an infant pushes down on the top circumference of the crib These and other aspects of the invention are set forth herein. Various aspects of the invention are further illustrated or described in the Drawings, Detailed Description and Claims herein.

DETAILED DESCRIPTION OF THE DRAWINGS

Figure 1A:
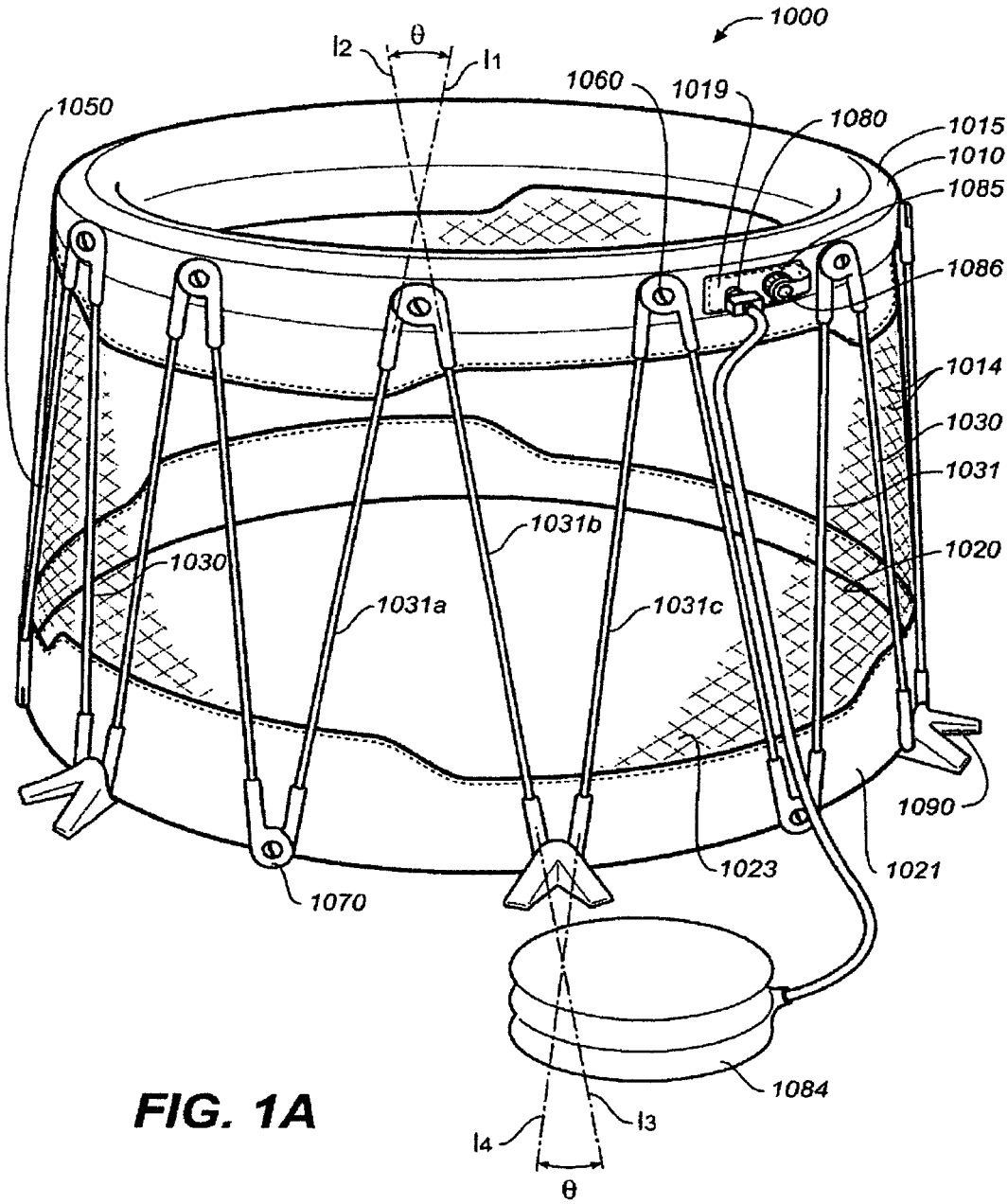
FIG. 1A is a side perspective view of a containment device in accordance with the invention.
Figure 1B:
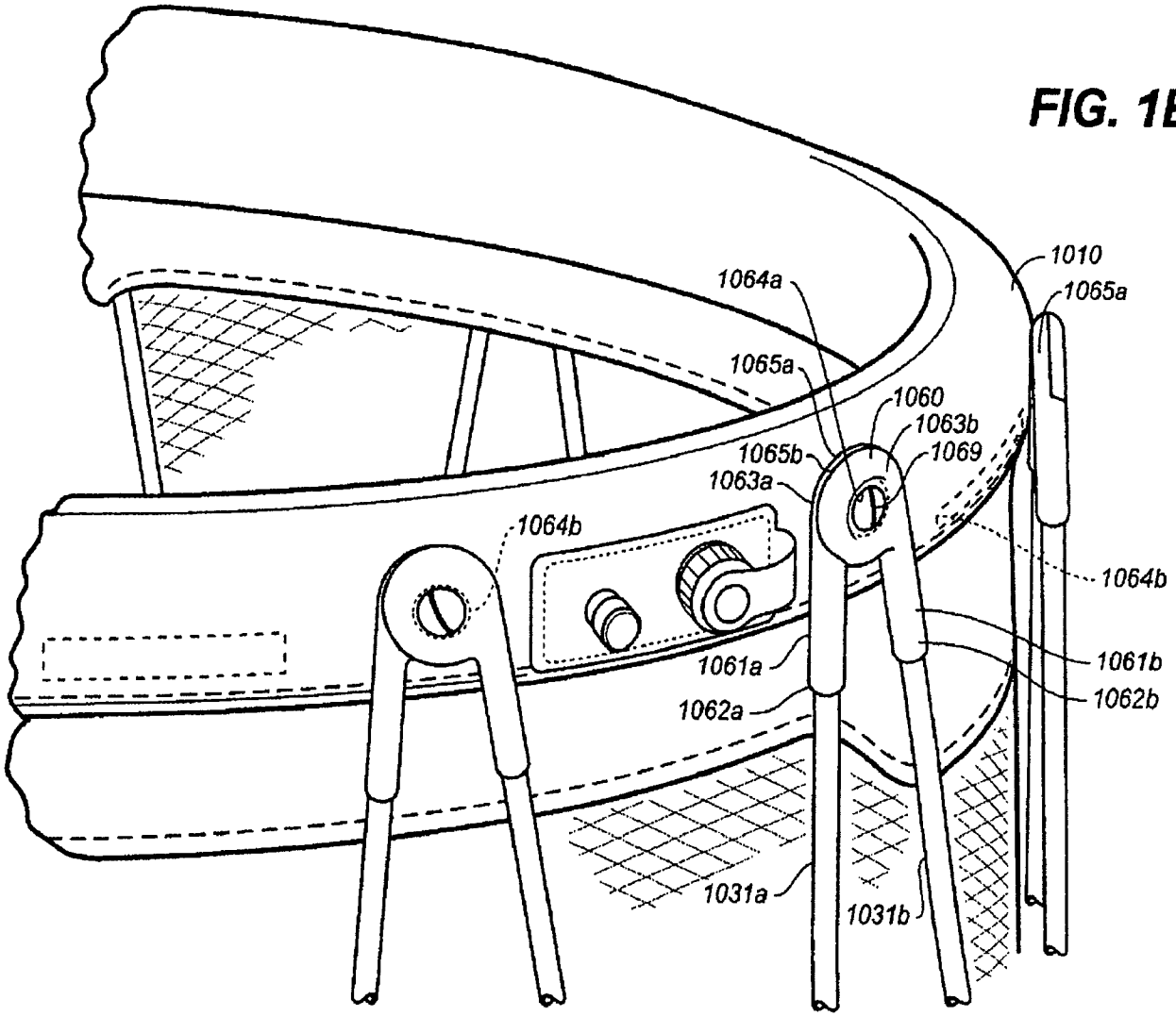
FIG. 1B is an enlarged front view of a portion of a support structure of the containment device of FIG. 1A in accordance with the invention.

Referring to FIG. 1A, a containment device 1000 in accordance with the invention is illustrated in an assembled configuration. The containment device 1000 comprises a upper radial support structure 1010, a lower radial support structure 1020, and longitudinal support structure 1030 comprising a plurality of longitudinal support struts 1031 supportively coupling upper radial support structure 1010 and lower radial support structure 1020. The upper radial support structure 1010 and lower radial support structure 1020 provide radially outward compressive forces that generally maintain the position of the longitudinal support structure 1030 and struts 1031 when the device is in an assembled configuration.

As illustrated in FIG. 1A, the struts 1031 are each coupled to the upper radial support structure 1010 and lower radial support structure 1020. However, it is contemplated that there may be intermediate support structures between the struts 1031 and the upper radial support structure 1010 and/or the lower radial support structure 1020. The struts 1031 are oriented with respect to each other about the circumference of the containment device 1000 so as to counteract forces applied between adjacent struts 1031, e.g., to the top of the upper radial support structure 1010, for example by an infant leaning on the top of the device 1000.

Generally the struts 1031 (and intervening structures if any) are connected to each other in an alternating top to bottom fashion. As illustrated, the struts 1031 may form a ring 1050 of alternating peaks and valleys or a plurality of sinusoidal shapes about the circumference of the device 1000, generally defined by the upper radial support structure 1010 and/or the lower radial support structure 1020.

Each strut 1031*b* is coupled to the upper radial support structure 1010 in proximity to a first adjacent strut 1031*a* on a first side of the strut 1031*b* and to the lower radial support structure 1020 adjacent second adjacent strut 1031*c* on a second, opposite side of the strut 1031*b*. For example, as illustrated in FIG. 1A, the struts 1031 are each coupled to adjacent struts 1031 and to the upper radial support structure by upper coupling members 1060 and lower coupling members 1070. The upper coupling members 1060 and lower coupling members 1070 permit the coupled struts 1031 to angularly rotate with respect to adjacent strut members 1031 so that the ring 1050 formed by the struts 1031 may be expanded for setting up the device or folded or compressed for storage.

According to one aspect, adjacent strut members 1031 are arranged in a non-parallel manner with respect to each other. As illustrated in FIG. 1A, a first adjacent support strut 1031*a* coupled to the upper radial support structure 1010 defines a line l1 forming an acute angle θ with respect to a line l2 defined by an adjacent support structure 1030*b* coupled to the upper radial support structure 1010. Similarly, the support structure 1030*b* is coupled to the lower radial support structure 1020 defining a line l3 forming an acute angle θ with respect to a line l4 defined by an adjacent support structure 1030*c* coupled to the lower radial support structure 1020. This orientation provides a counteracting upward force to a force applied to the top of the device, e.g., on the upper support member 1010, between support structures 1030*b* and 1030*c*.

The upper radial support member 1010 in FIG. 1A comprises an inflatable torroidal member 1015. The torroidal member 1015 has a radius to cross section ratio that enhances resistance to buckling deformation from a compressive load.

The lower radial support member 1020 comprises a circumferentially positioned material 1021 and a mattress 1023 having an oversized diameter d2 with respect to the diameter d1 of the circumferentially positioned material 1021 (FIG. 1E) so that when the mattress 1023 is positioned in the crib, it exerts a radially outward compressive force on the circumferentially positioned material 1021 which is transmitted to the longitudinal support structure 1030 including the connectors 1070 and struts 1031.

Figure 1D:
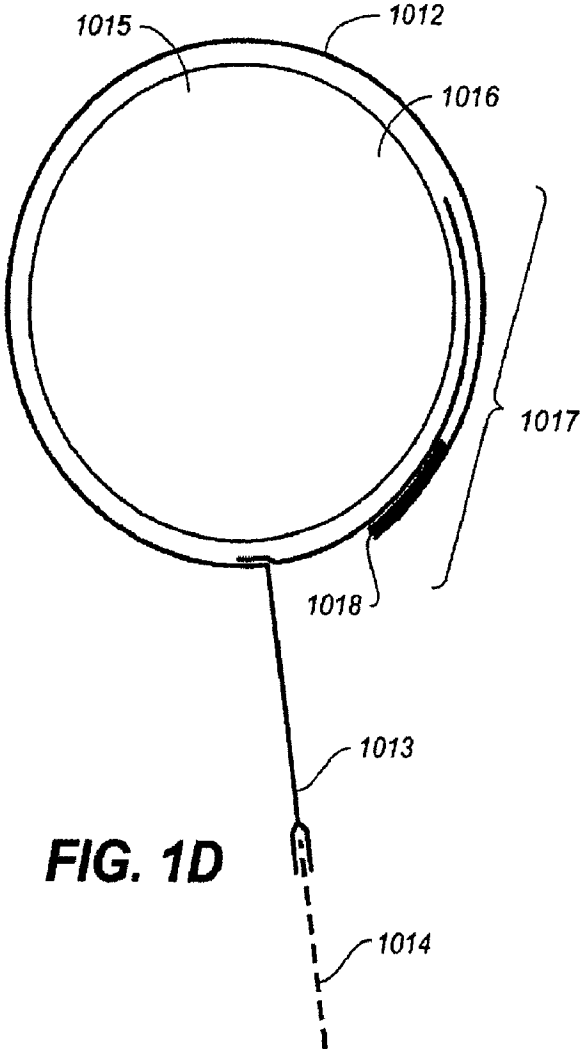
FIG. 1D is a schematic top partial cross section of the containment device of FIG. 1A in accordance with the invention.
Figure 1C:
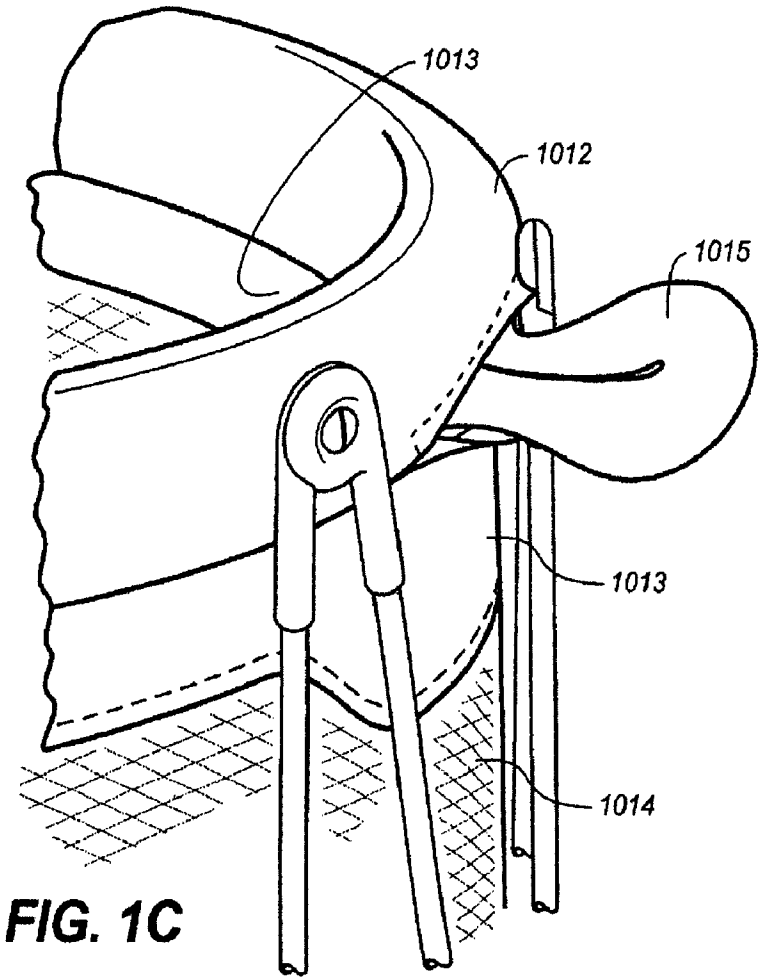
FIG. 1C is an enlarged perspective view of a portion of the containment device of FIG. 1A.
Figure 1E:
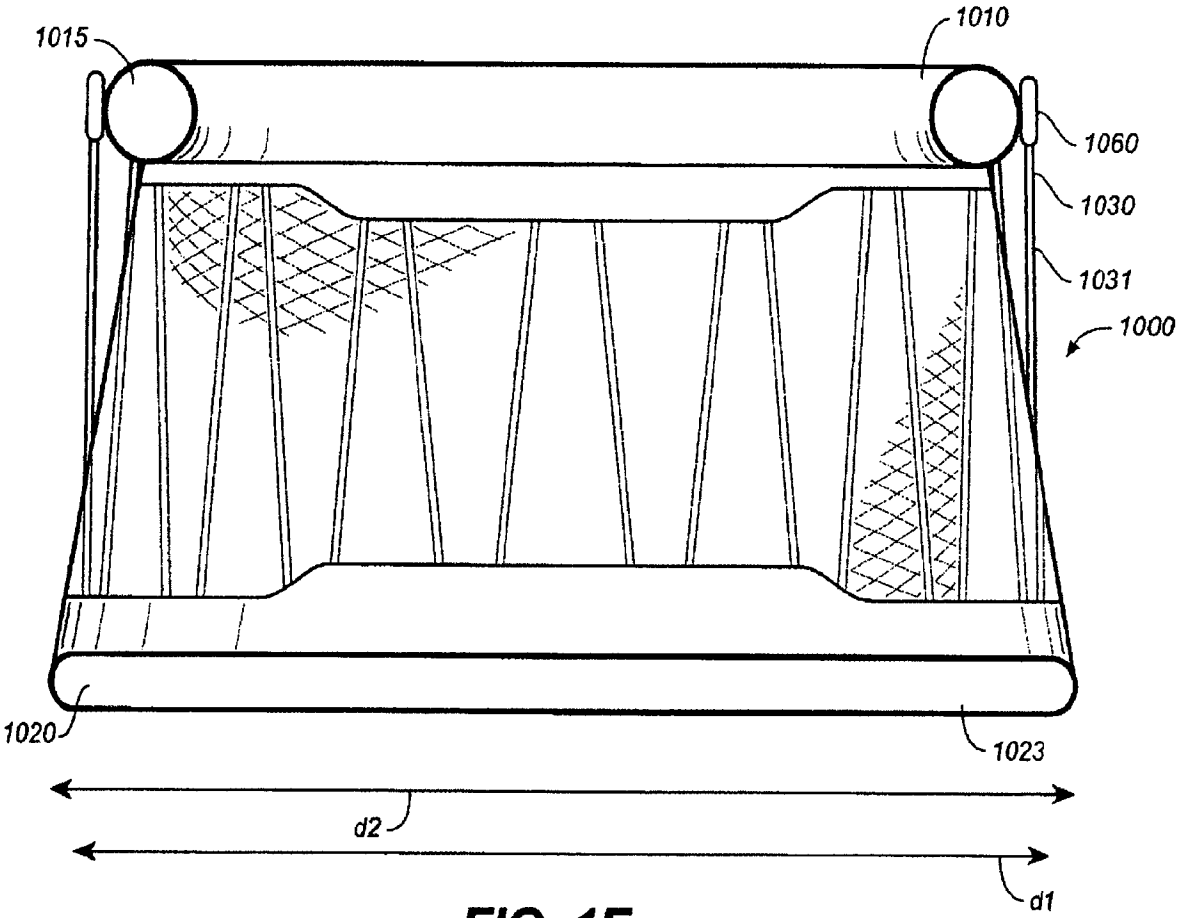
FIG. 1E is a side partial cross sectional view of the device of FIG. 1A.

The upper coupling member 1060 comprises a first strut connector 1061*a* and a second strut connector 1061*b* respectively comprising strut connector tubes 1062*a* and 1062*b* for respectively receiving struts 1031*a* and 1031*b*. The first connector 1061*a* has an end portion 1063*a* with an opening 1064*a* and the second connector 1061*b* has an end portion 1063*b* with an opening 1064*b*. When the openings 1064*a*, 1064*b* are aligned, the connectors may be screwed or bolted together with screw 1069. The end 1063*a* of the first connector 1061*a* has a curved portion 1065*a* that is rotatably received by a mating portion 1065*b* of end portion 1063*b* of second connector 1061*b*. When connected, the first and second strut connectors 1061*a*, 1061*b* are permitted limited rotation with respect to each other between an open position as illustrated in FIG. 1A when the containment device 1000 is set up for use, and a second position when the containment device is folded or dissembled for transport (FIG. 1H). The coupling of the upper and lower radial support structures 1010, 1020 and the longitudinal support structure 1030 to the material 1012 of the upper support structure and the material 1021 prevents hyper-rotation of the struts 1031*a* and 1031*b* with respect to each other. When folded, the struts prevent hyper-rotation with respect to each other. The lower coupling member 1070 is similarly constructed. The struts 1031 are constructed of a relatively rigid material such as a PVC, or other polymer or a metal rod, to provide longitudinal or columnar support. The connectors 1060, 1070 may be constructed of similar materials as the struts 1031. The struts 1031 may be inserted into openings which provide an interference fit.

The inflatable torroidal member 1015 comprises an inner tube 1016 positioned in a tubular material 1012. The tubular material 1012 is formed by a ring of material that is folded over to create an overlapping portion 1017 that is joined together by a closure mechanism 1018 such as Velcro. The overlapping portion 1017 and closure mechanism 1018 extend about the circumference of the torroidal member 1015 and may be opened to remove and replace inner tube 1016.

The tubular material 1012 is connected to flaps 1013 between which a mesh material 1014 is sewn. The mesh material 1014 creates openings for airflow and for light through which the child and the user may see. The mesh 1014 is attached on the bottom to material 1021 which also forms flaps between which the mesh material 1014 may be sewn.

Figure 2A:
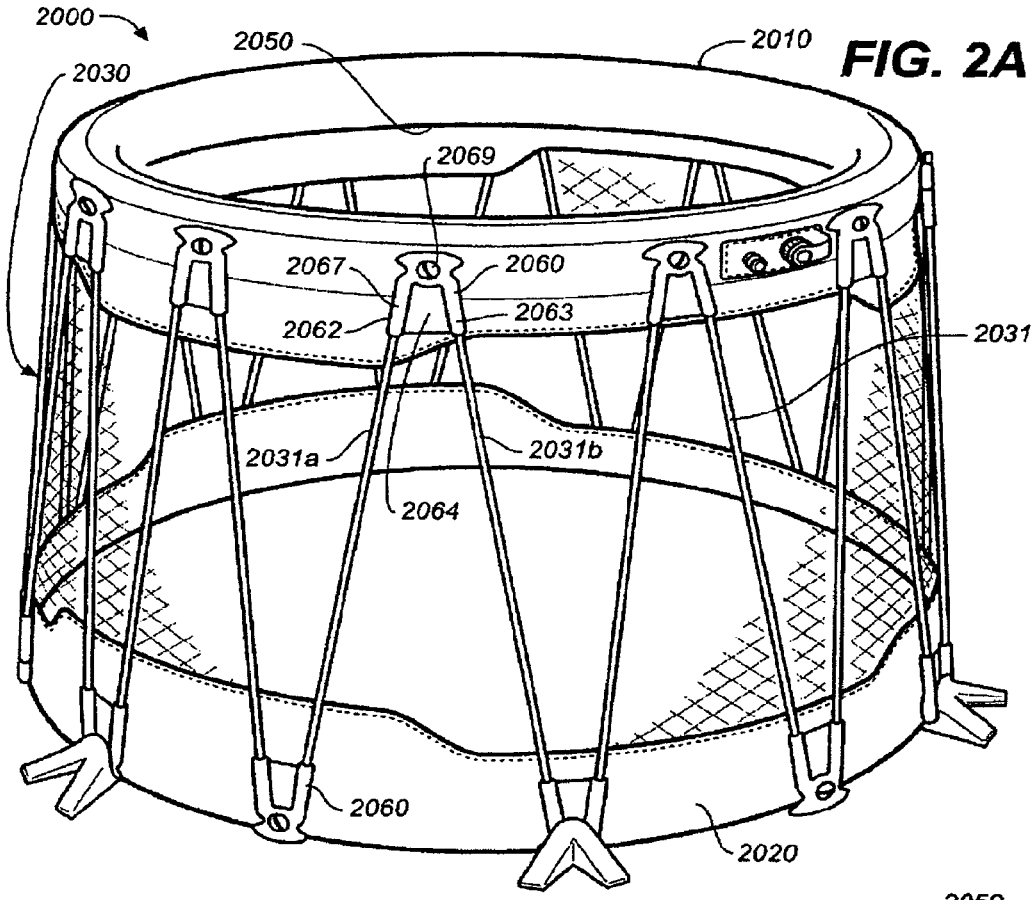
FIG. 2A is a side perspective view of a containment device in accordance with the invention.
Figure 2B:
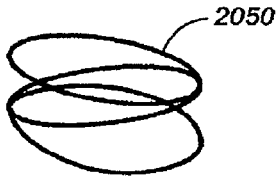
FIG. 2B is a schematic view of a support loop in a folded configuration.

The mattress 1023 may be inflatable or otherwise sufficiently rigid to provide an outward radially compressive force when positioned in the containment device. Other radially compressive members are also contemplated herein, for example an inflatable torroidal member such as the upper support member 1060, or e.g. a foldable, expandable ring 2050 such as a shape memory material (e.g. Nitinol or a polymer shape memory material) as illustrated in FIG. 2B (folded) and FIG. 2C (expanded). This expandable ring may also be used to provide a complimentary or a supplemental radial force.

FIG. 1A further illustrates an inflation valve 1080 to be coupled to an air pump 1084 and air release opening 1085 with cap 1086 for quick deflation of the inflatable torroidal member 1015. The inflation valve 1080 and release opening 1085 are located on the inflatable torroidal member 1015 and may be positioned through openings in a reinforced portion 1019 of the tubular material 1012 for easy external access. The cap 1086 may be attached to the reinforced portion 1019 of the tubular material 1012. As shown in FIGS. 1C and 1D, the tubular material 1012 may be opened to replace the inflatable torroidal member 1015 if necessary. The tubular material 1012 accordingly includes a Velcro closures flap 1018 extending around the circumference of the tubular material 1012.

The upper radial support member 1010 has an inner circumference that is smaller than the circumference of the lower radial support member 1020. Accordingly, the containment device 1000 conically tapers upward. This configuration helps to reduce tipping of the device by the child or infant. In addition, support feet 1090 may be provided about the lower support member 1020 to further reduce tipping of the device 1000. The support feet 1090 in accordance with once aspect, are configured to be attached onto the lower strut connectors 1070. Thus, the support feet 1090 may optionally be positioned on the device by the user.

Figure 1F:
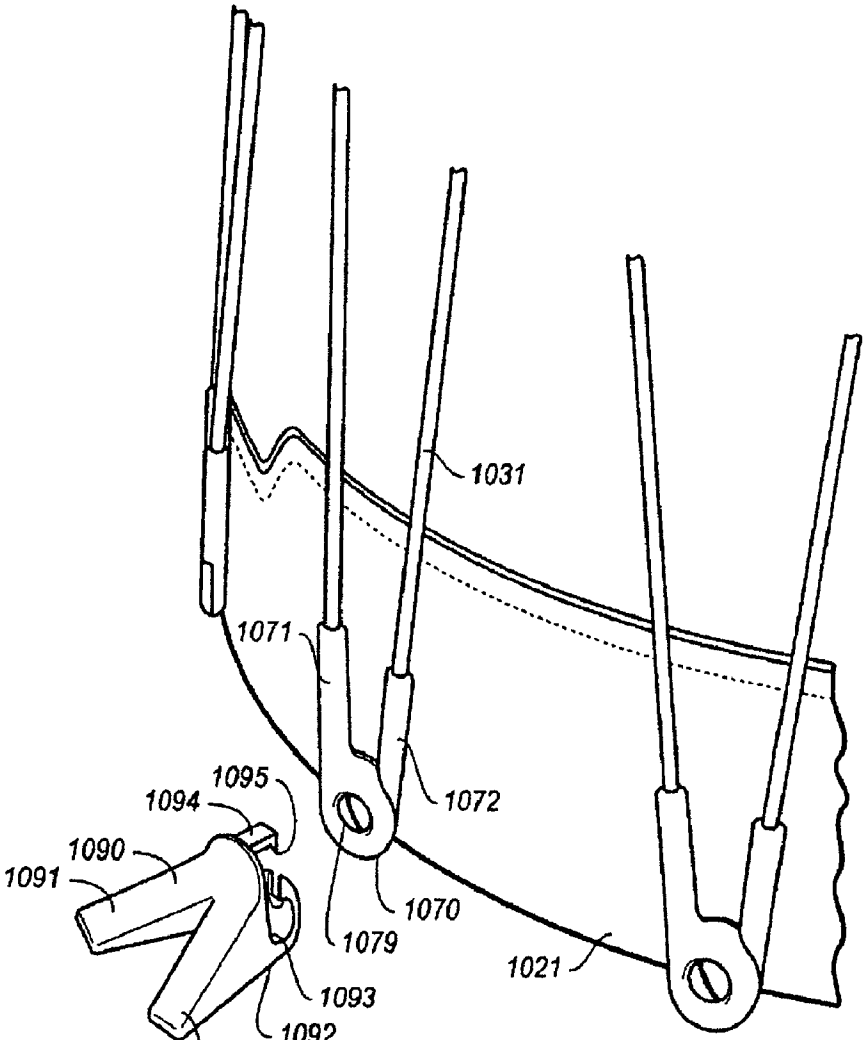
FIG. 1F is a side partial cross sectional view of the device of a portion of the device of FIG. 1A wherein a support foot is show connected to a lower coupling member.
Figure 1G:
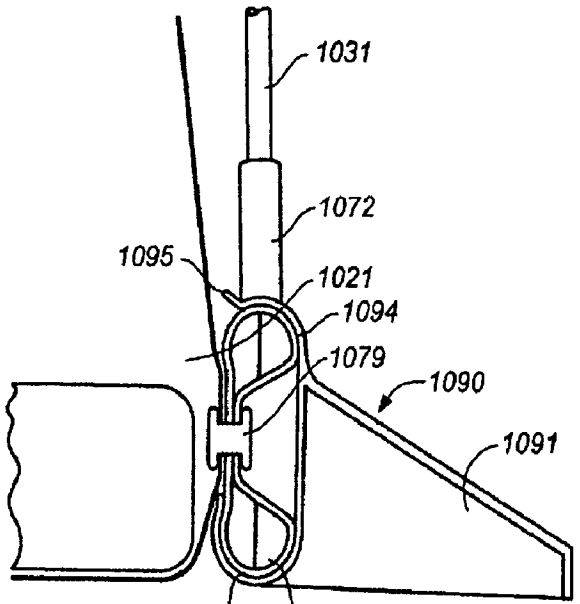
FIG. 1G is an exploded perspective view of a portion of the device of FIG. 1A wherein a support is shown with a lower coupling member.
Figure 1H:
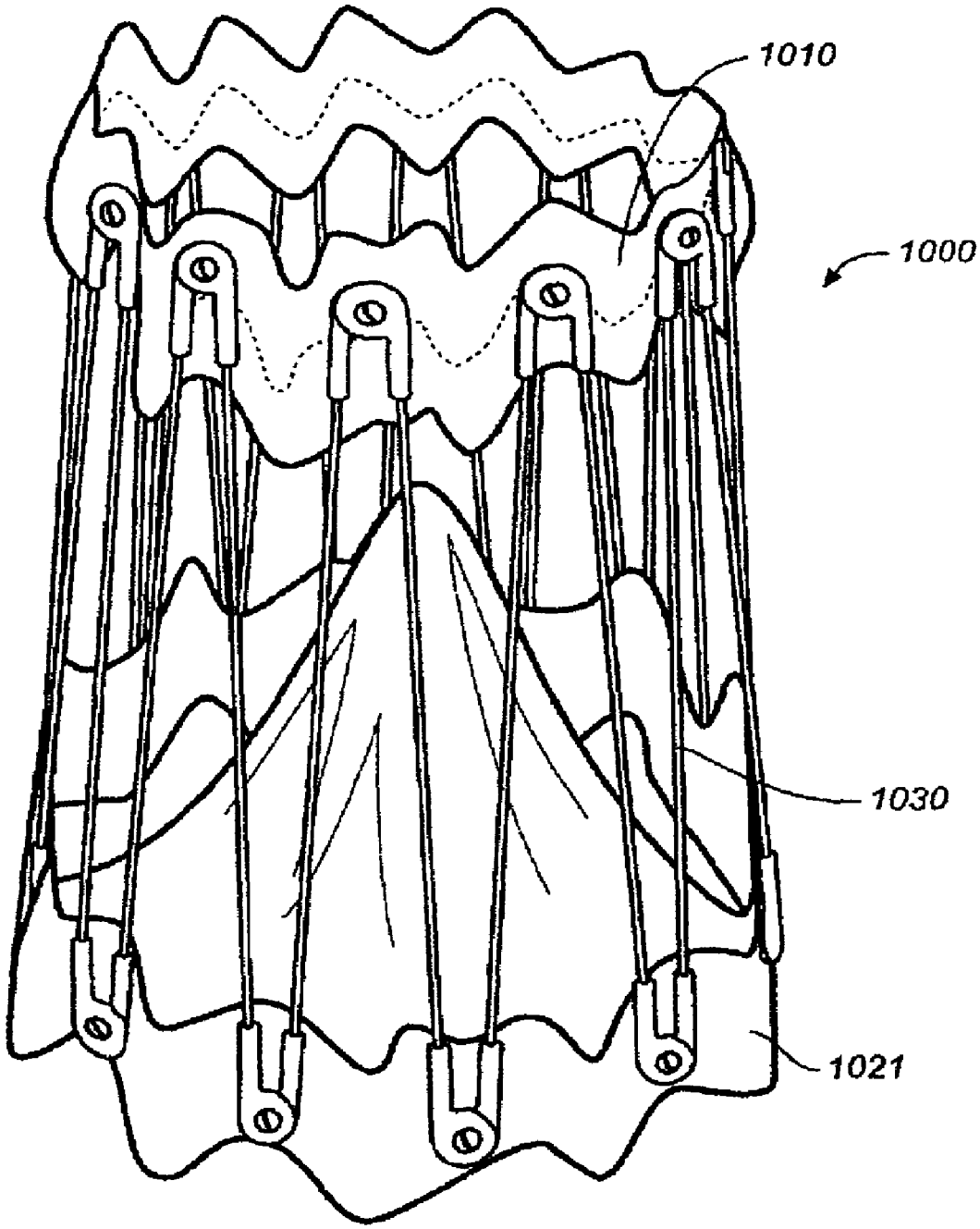
FIG. 1H is a perspective view showing the device of FIG. 1A as it is being folded.

As shown in FIGS. 1F and 1G, support feet 1090 may be removably attached to the device 1000 at the lower coupling member 1070. As shown, coupling member 1070 is screwed into material 1021 with screw 1079. A strut coupling tube 1072 couples a strut 1031 to the lower coupling member 1070. The support foot 1090 comprises two fingers 1091 extending radially outward from a connecting portion 1092. The connecting portion comprises a lower groove 1093 for receiving the lower coupling member 1070, and an upper tab 1094 that can be positioned between strut coupling tubes 1071, 1072. The tab 1094 has a detent 1095 that engages the lower coupling member 1070 between the coupling tubes 1071, 1072. The foot 1090 may be snapped into place by positioning the lower coupling member 1070 in the groove 1093 and positioning the tab 1094 between strut coupling tubes 1071, 1072 until it engages the lower coupling member 1070. The fingers 1091 provide additional support for the device 1000 and helps prevent tipping.

Figure 2C:
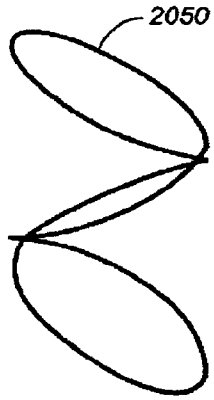
FIG. 2C is a schematic view of the support loop of FIG. 2B as it is being unfolded.
Figure 2D:
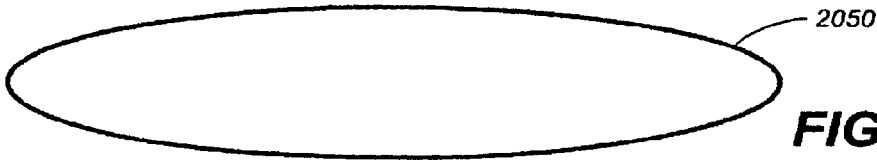
FIG. 2D is a schematic view of the support loop of FIG. 2C in an unfolded configuration.

FIG. 2A-2D illustrate a containment device 2000 in accordance with the invention. The containment device 2000 comprises an upper radial support member 2010, a lower radial support member 2020, and a longitudinal support structure 2030. The upper radial support member 2010 and lower radial support member 2020 are constructed in a similar manner as upper radial support member 1010 and lower radial support member 1020 described herein with reference to FIGS. 1A to 1D. Additional upper radial support comprises an expandable ring 2050, as shown in FIGS. 2B through 2D. The ring 2050 may be used alone or to supplement torroidal ring 2015. The ring 2050 may be constructed, for example, of a shape memory material (e.g. Nitinol or a polymer shape memory material). The longitudinal support structure 2030 comprises struts 2031 oriented in a manner to struts 1031 described herein with reference to FIGS. 1A to 1D. Struts 2031 are connected by upper and lower strut connectors 2060 that are screwed onto the device 2000 with screw 2069. Each strut connector 2060 comprises a one piece elastomer portion 2067 including tubular portions 2062, 2063 for receiving adjacent struts 2031*a*, 2031*b* in an interference fit. The tubular portions 2062, 2063 are connected by a flexible portion 2064 that is stretched or expanded to a limit when the containment device 2000 is assembled. (FIG. 2A) The flexible portion 2064 prevents the struts 2031*a*, 2031*b* from hyper-extending with respect to each other. At the same time, they are maintained in position by upper and lower radial support structures 2010, 2020. The flexible portion 2064 is foldable when the device 2000 is disassembled so that struts 2031 may be folded together to compact the device 2000 for transport or storage. The elastomeric material of the strut connector 2060 permits folding of the struts together. Alternatively the portion 2067 may comprise a flexible fabric.

Figure 3B:
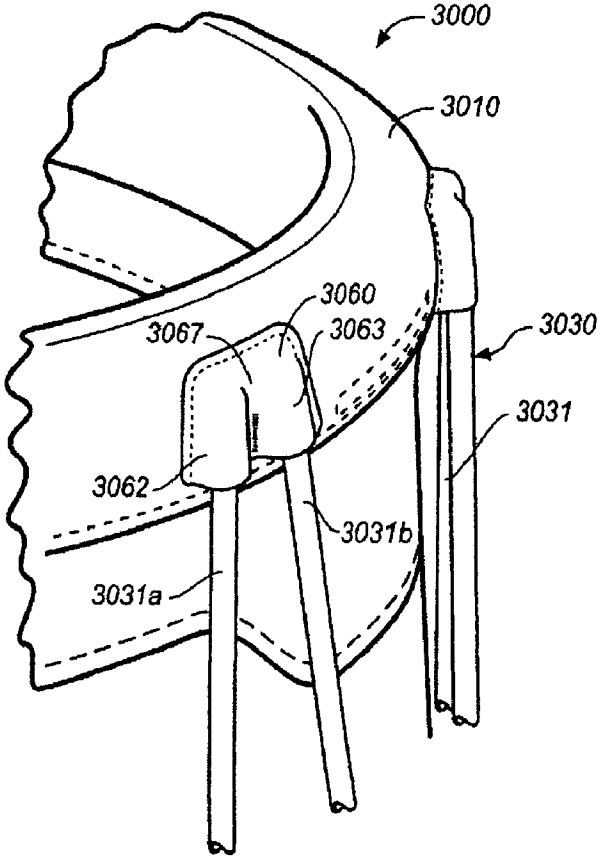
FIG. 3B is a perspective view of a portion of the containment device of FIG. 3A.
Figure 3A:
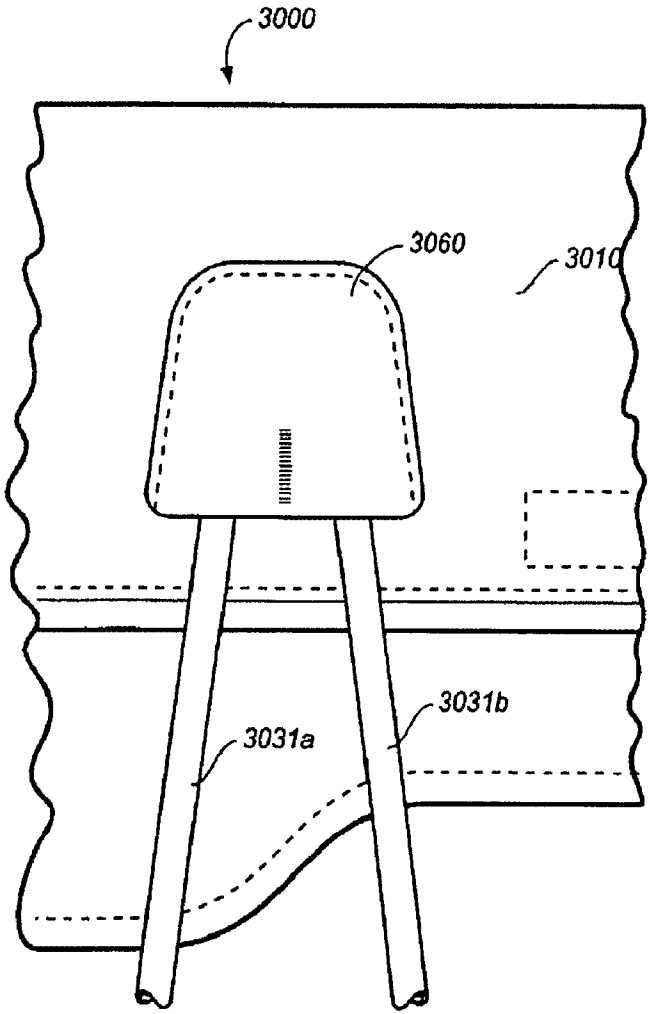
FIG. 3A is a front view of a portion of a support structure of a containment device in accordance with the invention.

FIGS. 3A-3C illustrate a containment device 3000 in accordance with the invention. The containment device 3000 comprises an upper radial support member 3010, a lower radial support member (not shown), and a longitudinal support structure 3030. The upper radial support member 3010 and lower radial support member are constructed in a similar manner as upper radial support member 1010 and lower radial support member 1020 described herein with reference to FIGS. 1A to 1D. The longitudinal support structure 3030 comprises struts 3031 oriented in a manner to struts 1031 described herein with reference to FIGS. 1A to 1D Struts 3031 are connected by upper and lower strut connectors 3060 that are sewn onto the device 3000. Each strut connector 3060 comprises a fabric pocket 3067 including tubular portions 3062, 3063 for receiving adjacent struts 3031*a*, 3031*b* which have ends sewn into the fabric pocket 3067. The tubular portions 3062, 3063 are flexible so that they may be stretched or expanded to a limit when the containment device 3000 is assembled. The material of the fabric pocket 3067 prevents the struts 3031*a*, 3031*b* from hyper-extending with respect to each other. At the same time, they are maintained in position by upper and lower radial support structures. The material of the pockets permit the struts 3031 to fold together to compact the device 3000 for transport or storage.

Figure 4B:
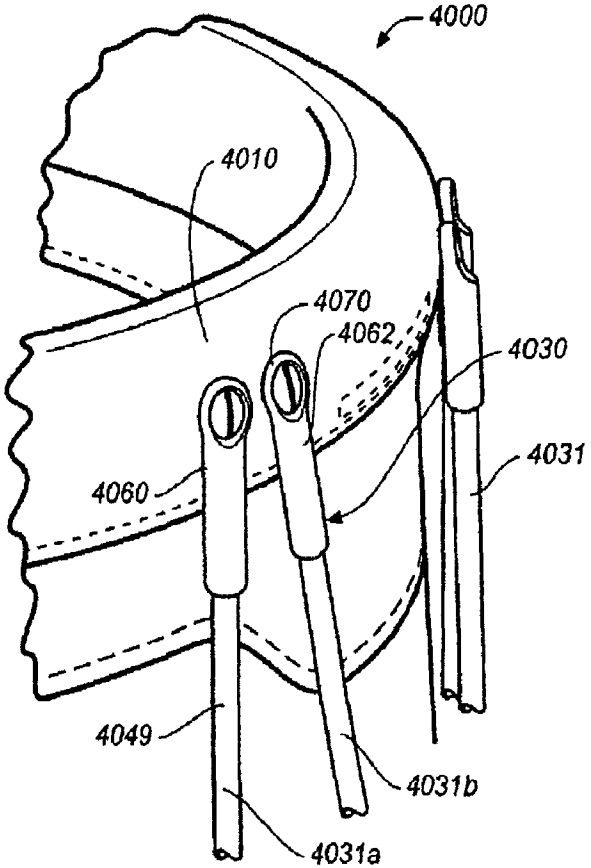
FIG. 4B is a perspective view of a portion of the containment device of FIG. 4A.
Figure 4A:
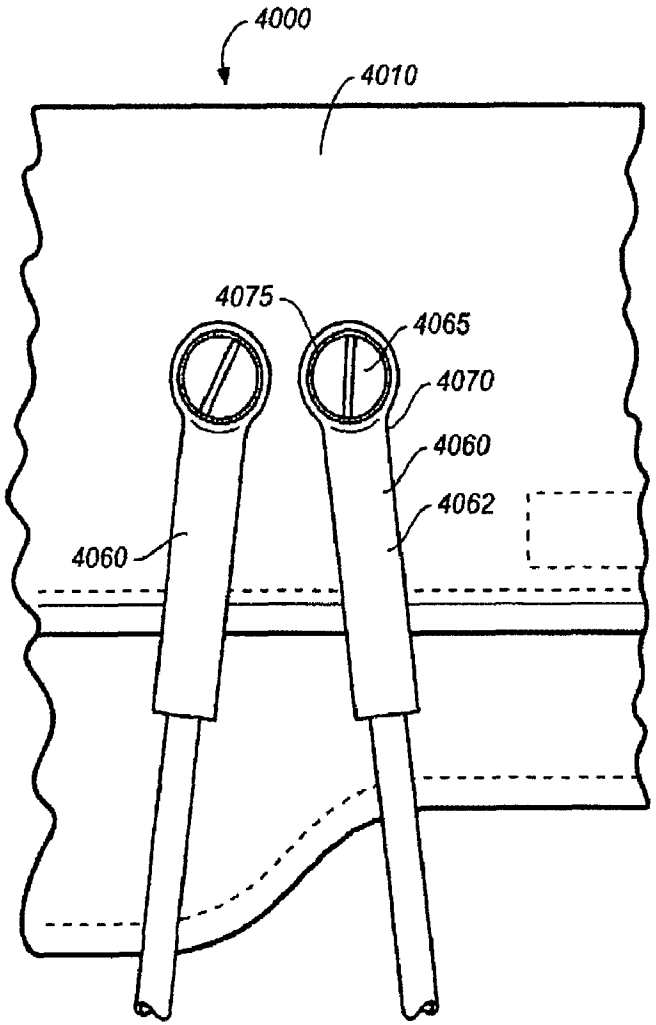
FIG. 4A is a front view of a portion of a support structure of a containment device in accordance with the invention.

FIG. 4A-4B illustrate a containment device 4000 in accordance with the invention. The containment device 4000 comprises an upper radial support member 4010, a lower radial support member (not shown) and a longitudinal support structure 4030. The upper radial support member 4010 and lower radial support member 4020 are constructed in a similar manner as upper radial support member 1010 and lower radial support member 1020 described herein with reference to FIGS. 1A to 1H. The longitudinal support structure 4030 comprises struts 4031 oriented in a manner to struts 1031 described herein with reference to FIGS. 1A to 1H. Struts 4031 are connected to upper and lower radial support structures 4010, 4020 by upper and lower strut connectors 4060. Each strut connector 4060 comprises a tubular portion 4062 for receiving an end of a strut 4031. Each strut connector 4060 is attached to an upper or lower radial support member 4010, 4020 with a screw 4065 through an opening 4075 in an end 4070 of the strut connector 4060. The coupling of the support structures and fabric prevent hyper-rotation of struts with respect to each other. Adjacent struts 4031*a*, 4031*b* while not directly connected are fixed in relation to each other in an orientation that provides support in a similar manner, for example, as described with reference to FIG. 1A or other examples herein. The struts 4031*a*, 4031*b* are indirectly coupled to each other through the radial support members.

Figure 5:
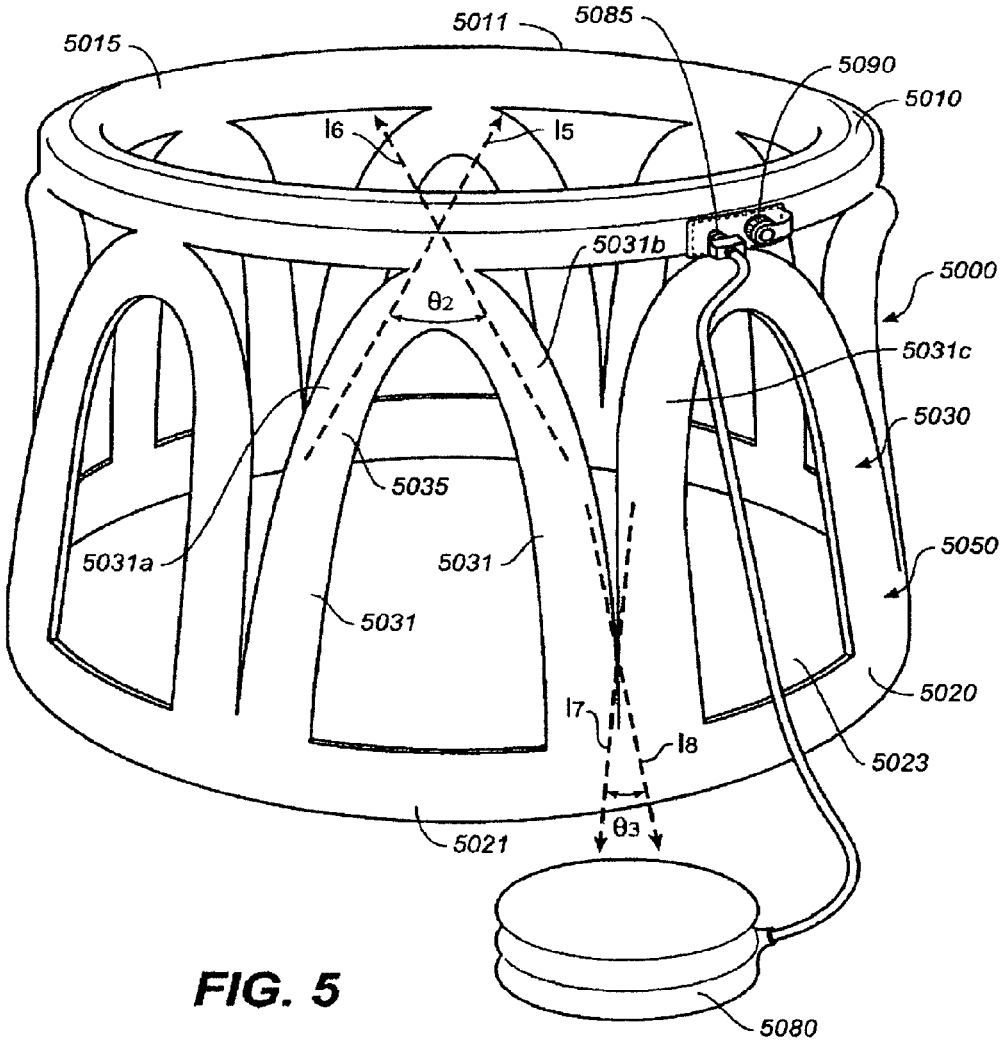
FIG. 5 is a side perspective view of a containment device in accordance with the invention.

FIG. 5 illustrates a containment device 5000 in accordance with the invention. The containment device 5000 comprises an upper radial support structure 5010, a lower radial support structure 5020, and longitudinal support structure 5030 comprising a plurality of inflatable arches 5035. The arches 5035 include plurality of longitudinal support portions 5031 supportively coupling upper radial support structure 5010 and lower radial support structure 5020. The longitudinal support portions 5031 of each arch 5035 as illustrated are contiguous portions of the inflatable arch 5035. However, the also may be separately inflatable portions. A pump 5080 may be used to inflate the upper radial support structure 5010 and longitudinal support structure 5030 through inflation valve 5085. The release valve 5090 may be opened to deflate the upper radial support structure and the longitudinal support structure. The configuration of the upper radial support structure 5010 and lower radial support structure 5020 and longitudinal support structure provides a resistance to downward forces applied at the top off the device.

As illustrated in FIG. 5, the longitudinal support portions 5031 are each coupled to the upper radial support structure 5010 and lower radial support structure 5020. They may be contiguous or may comprise a number of separately inflatable portions. It is also contemplated that there may be intermediate support structures between the longitudinal support portions 5031 and the upper radial support structure 5010 and/or the lower radial support structure 5020. The longitudinal support portions 5031 are oriented with respect to each other about the circumference of the containment device 5000 so as to counteract forces applied to the top 5011 of the upper radial support structure 5010, for example an infant leaning on the top of the device 5000.

Generally the longitudinal support portions 5031 (and intervening structures if any) are connected to or positioned adjacent each other in an alternating top to bottom fashion. For example, as illustrated, the support structure 5030 may form a ring 5050 of adjacent or connected arches 5035, about the circumference of the device 5000, generally defined by the upper radial support structure 5010 and/or the lower radial support structure 5020.

Each longitudinal support portion 5031 is coupled to the upper radial support structure 5010 in proximity to a first adjacent longitudinal support portions 5031*a* on a first side of the longitudinal support portion 5031*b* and to the lower radial support structure 5020 adjacent second adjacent longitudinal support portion 5031*c* on a second, opposite side of the longitudinal support portion 5031. According to one aspect, adjacent longitudinal portions 5031 are arranged in a nonparallel manner with respect to each other. As illustrated in FIG. 5, the first adjacent longitudinal support portion 5031*a* defines a line l5 forming an acute angle $\theta_2$ with respect to a line l6 defined by an adjacent longitudinal support portion 5031*b*. Similarly, longitudinal support portion 5031*b* defines a line l7 forming an acute angle $\theta_3$ with respect to a line l8 defined by an adjacent longitudinal support portion 5031*c* coupled to the lower radial support structure 5020. This orientation provides a counteracting upward force to a force is applied to the top of the device, e.g. between arches 5035.

The upper radial support member 5010 in FIG. 5 comprises an inflatable torroidal member 5015. The lower radial support member 5020 comprises a circumferentially positioned material 5021 and a mattress 5023 having an oversized diameter d2 with respect to the diameter d1 of the circumferentially positioned material 5021 so that when the mattress 5023 is positioned in the crib, it exerts a radially outward compressive force on the circumferentially positioned material 5021 which is transmitted to the longitudinal support structure 5030 including the longitudinal support portions 5031.

The upper radial support member 5010 has a circumference that is smaller that the circumference of the lower radial support member 5020. Accordingly, the containment device 5000 conically tapers upward. This configuration helps to reduce tipping of the device by the child or infant.

Figure 6:
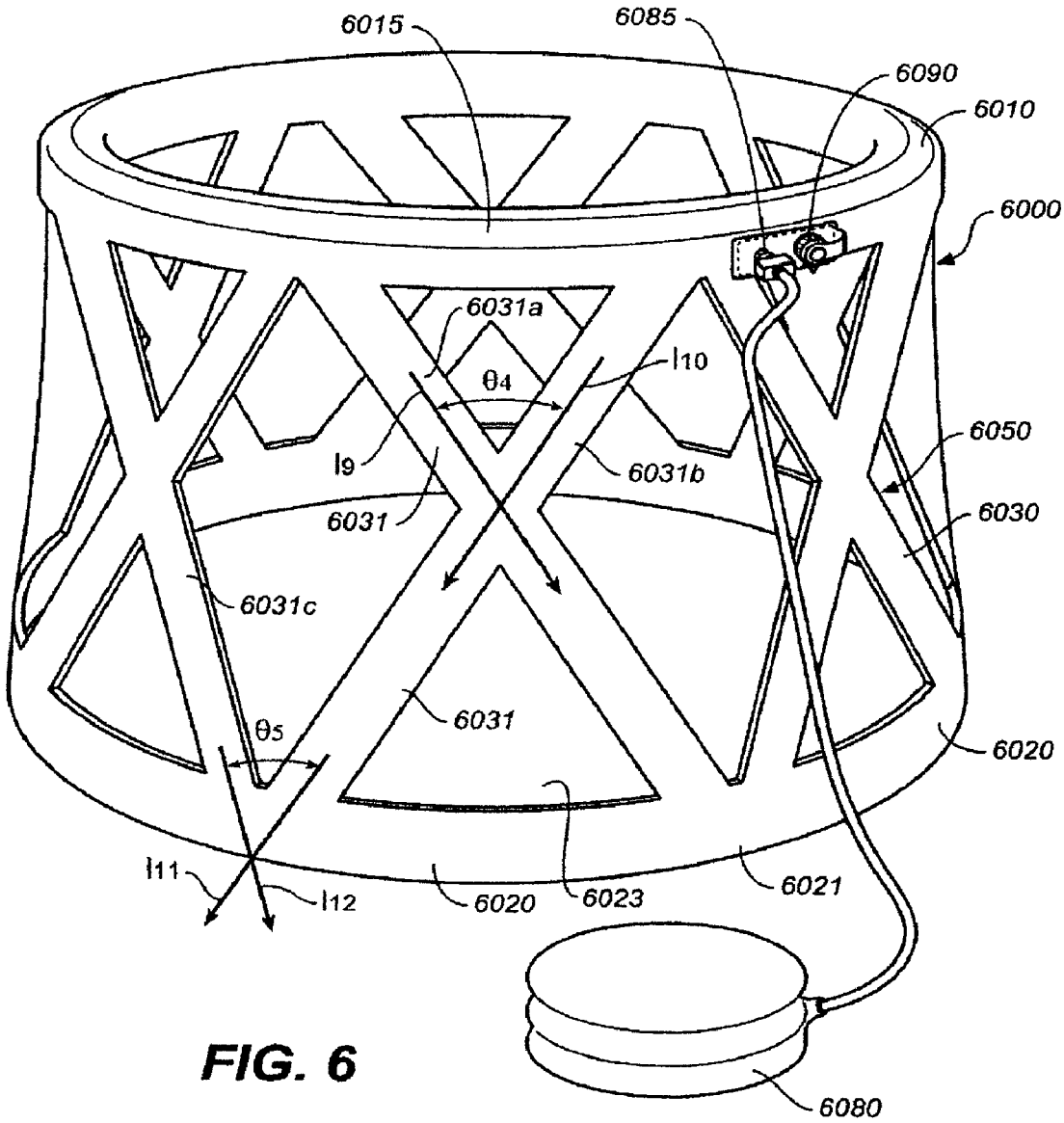
FIG. 6 is a side perspective view of a containment device in accordance with the invention.

FIG. 6 illustrates a containment device 6000 in accordance with the invention.

The containment device 6000 comprises a upper radial support portion 6010, a lower radial support portion 6020, and longitudinal support structure 6030 comprising a plurality of intersecting longitudinal support portions 6031 supportively coupling upper radial support structure 6010 and lower radial support structure 6020. The longitudinal support portions 6031 as illustrated are contiguous portions of the support structure 6030. However, the also may be separately inflatable portions. A pump 6080 may be used to inflate the upper radial support structure 6010, lower radial support structure 6020 and longitudinal support structure 6030 through inflation valve 6085. The release valve 6090 may be opened to deflate the upper radial support structure 6010, lower radial support structure 6020 and longitudinal support structure 6030.

As illustrated in FIG. 6, the longitudinal support portions 6031 are each coupled to the upper radial support structure 6010 and lower radial support structure 6020. They may be contiguous or may comprise a number of separately inflatable portions. It is also contemplated that there may be intermediate support structures between the longitudinal support portions 6031 and the upper radial support structure 6010 and/or the lower radial support structure 6020. The longitudinal support portions 6031 are oriented with respect to each other about the circumference of the containment device 6000 so as to counteract forces applied to the top of the upper radial support structure 6010, for example an infant leaning on the top of the device 6000.

Generally the longitudinal support portions 6031 (and intervening structures if any) are connected to or positioned adjacent another longitudinal support portion 6031 in an alternating top to bottom fashion. For example, as illustrated, the support structure 6030 may form a ring 6050 of adjacent or connected X's or diamond shapes about the circumference of the device 6000, generally defined by the upper radial support structure 6010 and/or the lower radial support structure 6020.

According to one aspect, adjacent longitudinal portions 6031 are arranged in a nonparallel manner with respect to each other. As illustrated in FIG. 6 a first longitudinal support portion 6031*a* defines a line 19 forming an acute angle θ4 with respect to a line 110 defined by an adjacent longitudinal support portion 6031*b*. Similarly, longitudinal support portion 6031*a* defines a line 111 forming an acute angle θ5 with respect to a line 112 defined by an adjacent longitudinal support portion 6031*c* coupled to the lower radial support structure. This orientation provides a counteracting upward force to a force is applied to the top of the device.

The upper radial support member 6010 in FIG. 6 comprises an inflatable torroidal member 6015. The lower radial support member 6020 comprises a circumferentially positioned material 6021 and a mattress 6023 having an oversized diameter d2 with respect to the diameter d1 of the circumferentially positioned material 6021 so that when the mattress 6023 is positioned in the crib, it exerts a radially outward compressive force on the circumferentially positioned material 6021 which is transmitted to the longitudinal support structure

6030 including the longitudinal support portions 6031. The configuration of the upper radial support structure 6010 and lower radial support structure 6020 and longitudinal support structure provides a resistance to downward forces applied at the top of the device The upper radial support portion 6010 has a circumference that is smaller that the circumference of the lower radial support portion 6020. Accordingly, the containment device 6000 conically tapers upward. This configuration helps to reduce tipping of the device by the child or infant.

The torroidal members described herein may be rings or other curved structures. According to one aspect, the curved structure comprises an inflatable structure. According to another aspect, such an inflatable structure comprises a torroidal structure with a cross sectional radius and an overall curved or generally circular shape with a radius. In the various embodiments described herein, the lower radial support structure may alternatively comprise an inflatable torroidal member.

In accordance with one aspect of the invention a plurality of interfacing triangular structures or other polygon structures form a ring of a crib or containment device.

Figure 7:
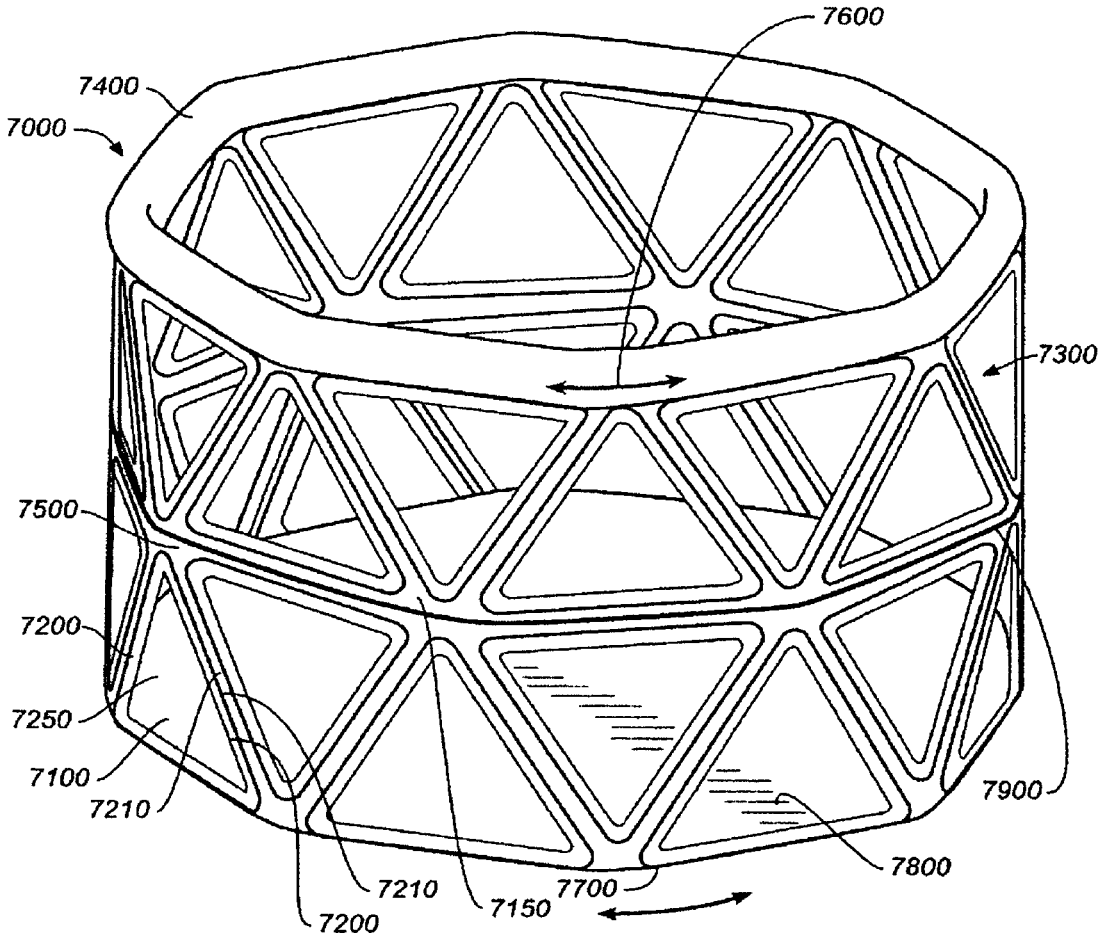
FIG. 7 is a side perspective view of a containment device in accordance with the invention.

Referring now to FIG. 7, a device 7000 in accordance with the invention is illustrated. The device 7000 comprises a plurality of triangular structures 7100 coupled in a ring 7300 by a material 7150. The triangular structures comprise outer support members 7200 forming the triangular shape and an inner mesh material 7250 attached to the support members 7200. The sides 7210 of the triangular structures 7100 defined by support members 7200 either interface with other sides 7210 of adjacent triangular structures 7100 or define or interface with an upper circumference 7600 or lower circumference 7700 of the ring 7300. A mid circumference 7500 of the ring 7300 where sides 7210 of the triangular structures 7100 interface, may have either a greater diameter or a smaller diameter than the diameter of an upper circumference 7600 and the lower circumference 7700. The ring 7300 is foldable at the middle circumference, and then at the interfaces of the sides 7210 of the triangle structures 7100 so that the device 7000 may be folded for storage. An inflatable upper support member 7400 is position around the upper circumference of the ring 7300 to hold the triangles at the upper circumference 7600 in place with respect to each other. A lower inflatable support member or alternatively a lower support member 7800 comprising an oversized diameter mattress as describe in other embodiments herein, may be used to hold the triangle structures 7100 at the lower circumference 7700 in place. Similarly, a mid-support structure 7900 may be positioned around the mid circumference 7500 to hold the triangle structures 7100 in position with respect to each other at the mid circumference 7500. For example, the mid support structure 7900 may comprise an expandable or shape memory ring such as the ring 2050 described above with reference to FIGS. 2A to 2D. While triangular patterns are illustrated other polygons are contemplated herein as support structures for the ring. The triangular structures interface with each other in a manner that resists downward forces applied at the upper periphery of the ring 7300. Additional radial compressive support may be provided as described. The support members 7200 of a triangle structure 7100 may comprise, for example, wire, wood metal or plastic members or structures interconnected or integral with one another the triangular structure 7100. Alternatively, the support members may comprise inflatable members or portions of an overall inflatable structure making up one or more portions of the device 7100. The device 7100 may also be entirely inflatable, thus not requiring folding as described above.

The construct or configuration of the longitudinal support structure or structures herein contemplates a number of different variations, for example, a cross over diamond shape, or a plurality of connected rings each ring comprising sinusoidal structures, a plurality of arch members, a diamond structure or structures, a triangular structure or structures, or other polygon structure or structures, or the like are contemplated herein.

The invention claimed is:

1. A child containment device wherein the containment device has a first deployed position and a second folded position, the containment device comprising:

a longitudinal support structure comprising a plurality of support portions, each of said plurality of support portions having an adjacent one of said plurality of support portions, and when in the first deployed position, each of said plurality of support portions configured in a non-parallel arrangement with respect to said adjacent one of said plurality of support portions and defining a circumference;

a material having openings configured to permit airflow to a user, positioned about at least a portion of the circumference;

an upper radial support structure positioned about the circumference and configured to provide a radial outward compressive force to said plurality of support portions about the circumference to thereby reduce movement of the support portions with respect to each other; and a lower support structure configured to provide an outward force to said plurality of support portions about the circumference to thereby reduce movement of the support portions with respect to each other.

2. The device of claim 1:

wherein the lower support structure comprises a lower radial support structure positioned about the circumference and configured to provide a radially outward compressive force to said plurality of support portions about the circumference to thereby reduce movement of the support portions with respect to each other.

3. The device of claim 1 wherein said device comprises an upper portion and a lower portion and has a conical shape with an opening in the upper portion; and wherein the upper portion has an upper circumference and the lower portion has a lower circumference, wherein the upper circumference is smaller than the lower circumference.

4. A child containment device wherein the containment device has a first deployed position and a second folded position said containment device comprising:

an upper portion;

a lower portion, wherein the upper portion and the lower portion define a circumferential portion;

a longitudinal support structure comprising a plurality of longitudinal support elements; and a plurality of non-rigid couplers;

wherein the longitudinal support elements are coupled to each other about the circumferential portion with the non rigid couplers to form a plurality of peaks and valleys; and wherein the upper portion comprises a outward compressive element configured to provide an outward compressive force to the plurality of longitudinal support elements to thereby reduce movement of the longitudinal support elements with respect to each other.

5. The child containment device of claim 4 wherein the longitudinal support elements comprise rigid members.

6. The child containment device of claim 4 wherein the radially outward compressive element comprises an inflatable member.

7. The child containment device of claim 4 wherein the radially outward compressive element comprises a spring member.

8. The child containment device of claim 4 wherein the upper portion comprises a torroidal member.

9. The child containment device of claim 4 wherein the device has a conical shape with an opening in the upper portion; and wherein the upper portion has an upper circumference and the lower portion has a lower circumference, wherein the upper circumference is smaller than the lower circumference.

10. The child containment device of claim 4 wherein the plurality of non-rigid couplers comprises at least one pocket portion configured to couple the longitudinal support elements to the upper portion to thereby non-rigidly couple the longitudinal support elements.

11. The child containment device of claim 10 wherein at least one of the plurality of non-rigid couplers is coupled to the lower portion of the containment device, wherein the containment device further comprises a lower support structure configured to provide an outward compressive force to a plurality of support portions coupled to the lower portion.

12. The child containment device of claim 4 wherein the plurality of non-rigid couplers comprises at least one pivotally moveable connector coupled to the upper portion.

13. The child containment device of claim 12 wherein at least one of the plurality of non-rigid couplers is coupled to the lower portion of the containment device, wherein the containment device further comprises a lower support structure configured to provide an outward compressive force to a plurality of support portions coupled to the lower portion.

14. The child containment device of claim 4 wherein the outward compressive element configured to provide a radially outward compressive force to the longitudinal support elements to thereby reduce movement of the longitudinal support elements with respect to each other.

15. The child containment device of claim 4 further comprising a material having openings configured to permit airflow to a user, positioned about at least a portion of the circumferential portion; and an opening in the upper portion configured to receive the user therethrough for placement into the device.

16. A child containment device comprising an upper inflatable support structure and a longitudinal support structure wherein the longitudinal support structure comprises a plurality of rigid members, wherein the containment device has a first deployed position and a second folded position wherein the inflatable support structure is deflatable and wherein the rigid members are foldable with respect to each other;

wherein the plurality of rigid members are non-rigidly coupled to each other with a plurality of non-rigid coupling members, and wherein in the first deployed position the upper inflatable support structure is configured to provide an outward compressive force to the rigid members and the non-rigid coupling members to thereby reduce movement of the rigid members with respect to each other.

17. The child containment device of claim 16 wherein each of the rigid members are coupled to an adjacent rigid member.

18. The child containment of claim 16 wherein said device comprises an upper portion and a lower portion and has a conical shape with an opening in the upper portion; and wherein the upper portion has an upper circumference and the lower portion has a lower circumference, wherein the upper circumference is smaller than the lower circumference.

19. The child containment device of claim 16 wherein the upper inflatable support structure is configured to provide a radially outward compressive force to the rigid members and the non-rigid coupling members to thereby reduce movement of the rigid members with respect to each other.

20. A child containment device wherein the containment device has a first deployed position and a second folded position said containment device comprising:

an upper portion;

a lower portion, wherein the upper portion and the lower portion define a circumferential portion;

a longitudinal support structure comprising a plurality of longitudinal support elements; and a plurality of moveable couplers;

wherein the longitudinal support elements are coupled to each other about the circumferential portion with the moveable couplers to form a plurality of peaks and valleys; and wherein the upper portion comprises an outward compressive element configured to provide an outward compressive force to the plurality of longitudinal support elements to thereby reduce movement of the longitudinal support elements with respect to each other.

21. The child containment device of claim 20 wherein the outward compressive element is configured to provide a radially outward compressive force to the longitudinal support elements to thereby reduce movement of the longitudinal support elements with respect to each other.

22. The child containment device of claim 20 further comprising a material having openings configured to permit airflow to a user, positioned about at least a portion of the circumferential portion; and an opening in the upper portion configured to receive the user therethrough for placement into the device.

* * * * *